US009945126B2

(12) United States Patent
Nelson

(10) Patent No.: US 9,945,126 B2
(45) **Date of Patent: *Apr. 17, 2018**

(54) GUTTER LEAF SLIDE BRIDGE

(71) Applicant: B & J Concepts, LLC, Columbus, OH (US)

(72) Inventor: Jerome W. Nelson, Columbus, OH (US)

(73) Assignee: B & J Concepts, LLC, Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/632,667

(22) Filed: Jun. 26, 2017

(65) Prior Publication Data

US 2017/0292272 A1 Oct. 12, 2017

Related U.S. Application Data

(60) Continuation of application No. 15/267,412, filed on Sep. 16, 2016, now Pat. No. 9,689,166, which is a continuation of application No. 15/015,180, filed on Feb. 4, 2016, now Pat. No. 9,523,204, which is a division of application No. 14/626,975, filed on Feb. 20, 2015, now Pat. No. 9,267,292, which is a division (Continued)

(51) Int. Cl.

| | |
|---|---|
| ***E04D 13/076*** | (2006.01) |
| *E04D 13/04* | (2006.01) |
| *E04D 13/064* | (2006.01) |

(52) U.S. Cl.

CPC ..... *E04D 13/076* (2013.01); *E04D 13/04* (2013.01); *E04D 13/064* (2013.01)

(58) Field of Classification Search

CPC . E04D 13/064; E04D 13/072; E04D 13/0725; E04D 13/076; E04D 13/04

USPC ..... 52/11, 12, 15

See application file for complete search history.

(56) References Cited

U.S. PATENT DOCUMENTS

| | | | |
|---|---|---|---|
| 1,101,047 | A | 6/1914 | Yates |
| 2,090,997 | A | 8/1937 | French |

(Continued)

FOREIGN PATENT DOCUMENTS

| | | |
|---|---|---|
| DE | 19952823 | 5/2001 |
| GR | 1005445 | 2/2007 |

*Primary Examiner* — Adriana Figueroa
*Assistant Examiner* — Jessie Fonseca
(74) *Attorney, Agent, or Firm* — Jason H. Foster; Kremblas & Foster

(57) ABSTRACT

A gutter protecting apparatus includes a plurality of substantially parallel rods extending in a downward slope from near a roof edge to and beyond the far side of the gutter. The rods extend substantially perpendicular to the gutter's length and to a frame to which the rods connect at the upper edge. Preferably, the lower rod ends are spaced above and slightly beyond the far edge of the gutter to allow debris to pass the gutter without catching. Legs can extend down from some rods to the gutter's far edge to provide support. The apparatus can be pivotably mounted to the roof, the fascia or the gutter, permitting access beneath. The apparatus forms a cage-like covering over the gutter to exclude matter and small creatures, while allowing the liquid to flow past. Sunlight bypassing the rods and movement of air through the gutter make the water exiting the downspout cleaner.

9 Claims, 6 Drawing Sheets

Related U.S. Application Data of application No. 14/210,699, filed on Mar. 14, 2014, now Pat. No. 9,021,748.

(60) Provisional application No. 61/782,625, filed on Mar. 14, 2013.

(56) References Cited

U.S. PATENT DOCUMENTS

| | | | | |
|---|---|---|---|---|
| 2,494,780 | A | 1/1950 | Schmidt | |
| 4,032,456 | A | 6/1977 | Berce | |
| 5,092,086 | A | 3/1992 | Rognsvoog, Sr. | |
| 5,755,061 | A | 5/1998 | Chen | |
| 6,067,755 | A * | 5/2000 | Maanum | E04D 13/076 248/48.1 |
| 6,164,020 | A | 12/2000 | Nitch | |

* cited by examiner

GUTTER LEAF SLIDE BRIDGE

CROSS-REFERENCES TO RELATED APPLICATIONS

This application is a continuation of U.S. application Ser. No. 15/267,412, filed Sep. 16, 2016, now U.S. Pat. No. 9,689,166, which is a continuation of U.S. application Ser. No. 15/015,180, which is a divisional of U.S. Pat. No. 9,267,292, which is a divisional of U.S. Pat. No. 9,021,748, which claims the benefit of U.S. Provisional Application No. 61/782,625 filed Mar. 14, 2013. The foregoing prior applications and patents are incorporated herein by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

The invention relates broadly to structures used to keep debris from gutters, and more particularly to a structure for preventing leaves from entering into gutters.

Rain gutters (also known as eavestroughs or, gutters) are narrow channels or troughs that collect and divert water flowing off of a roof. Gutters have been disposed at roof edges for centuries to catch precipitation and either redirect it to a storage vessel, such as an underground cistern, or away from the foundation of the building to prevent the precipitation from damaging the building to which the gutters are attached. Conventional gutters mount to a face of the building, such as a soffit fascia, with the lip of the rear edge of the gutter just under the drip edge of the building's roof. When water runs down the roof, it falls under the force of gravity into the gutter, collects in pools and flows by gravity out of the inclined gutter into a vertical downspout. The downspout carries the water to a storage vessel or away from the foundation of the building.

Solid particles that fall onto roofs also fall into uncovered gutters. For example, sticks, leaves, seeds, needles and other particles fall onto roofs, typically from overhanging trees, and then roll or slide into gutters. Smaller particles in small quantities can be carried by rain water out of gutters and are harmless, other than when they deteriorate in cisterns and cause spoilage. However, sticks and larger particles, or small particles in larger quantities, cannot be carried away by the water flowing in a gutter. Such sticks and particles collect together to form a barricade, and then smaller particles are filtered by the debris to block the satisfactory flow of water from the gutter into the downspout. The water then collects in the gutter and creates a sanitary hazard and/or overflows, thereby damaging the building and gutter and defeating the purpose of the gutter system.

There are numerous systems for preventing, or reducing, the infiltration of particles into the open tops of gutters. These are placed over gutters to keep water flowing instead of being clogged by leaves and debris. These systems include porous, filtering materials, such as expanded metal and polymer screens, along with solid "caps" that drive solid particles over the cap while depending on the surface tension of water to flow over the cap and gutter and around a solid panel into the gutter. Brush-like structures have also been placed in gutters, and coiled, spring-shaped wire structures have been placed in gutters to extend along the length of the gutter. One problem with the coil apparatus is that leaves and other debris that are low-hanging through the wires cannot clear the far edge of the gutter as they move downhill and they catch the far edge of the gutter. The surface tension method using a sheet-type cap over the gutter appears to be the best at self-clearing, but it can cause a mold slime-like formation in the darkened gutter.

The prior art of which the inventor is aware provides advantages over an open-top gutter, but also disadvantages. To applicant's knowledge, all prior art fails to provide sufficient certainty that debris will neither clog the gutter nor the filtering apparatus. Therefore, the need exists for a method and means for keeping gutters clear of leaves and other debris while allowing sunlight and airflow into the gutter, which reduces mold and slime buildup on the filter and gutter.

BRIEF SUMMARY OF THE INVENTION

The invention contemplates a means to bridge over a gutter to allow leaves and other debris to slide off the roof, across the bridging structure above the gutter, and onto the ground without dropping into or catching onto, the gutter or filter. This is accomplished with a novel bridging structure that is described herein and shown in the illustrations. The structure has a plurality of rods aligned parallel to and along the downward sliding direction of the leaves and other debris. These rods are positioned substantially parallel and as close to one another as possible to prevent significant debris from falling into the gutter between the rods while still allowing the water to pass through into the gutter through the openings between the rods.

Except for very small particulate, the apparatus prevents most or all debris that comes into contact with a roof from entering the gutter, while still allowing rain and other liquid and small particulate to be carried away in a desirable manner by the gutter and downspouts. The apparatus also allows wind to blow up through the gutter filter to dislodge leaves and other debris, as well as dry out the gutter by the sun penetrating through the aligned rods of the apparatus.

The apparatus is referred to herein as a gutter leaf slide bridge (GLSB). The GLSB is designed so that the water and small quantities of very small particles that constitute non-clogging debris fall into the gutter, and larger debris, such as leaves, sticks and large seeds, roll or slide across the GLSB beyond the outside edge of the gutter and fall to the ground. The GLSB allows sunlight and air movement through the gutters beneath it, thereby preventing a slimy mold buildup in the gutter found with many systems that enclose the gutter.

Figure 1:
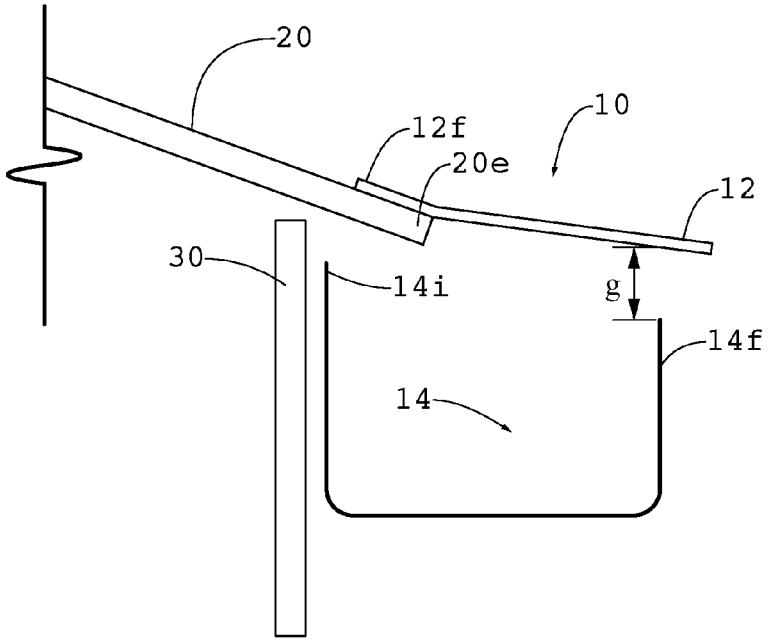
FIG. 1 is a side schematic view illustrating an embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional Application No. 61/782,625 filed Mar. 14, 2013 and U.S. Non-provisional application Ser. No. 14/210,699 filed Mar. 14, 2014 are hereby incorporated in this application by reference.

Figure 11:
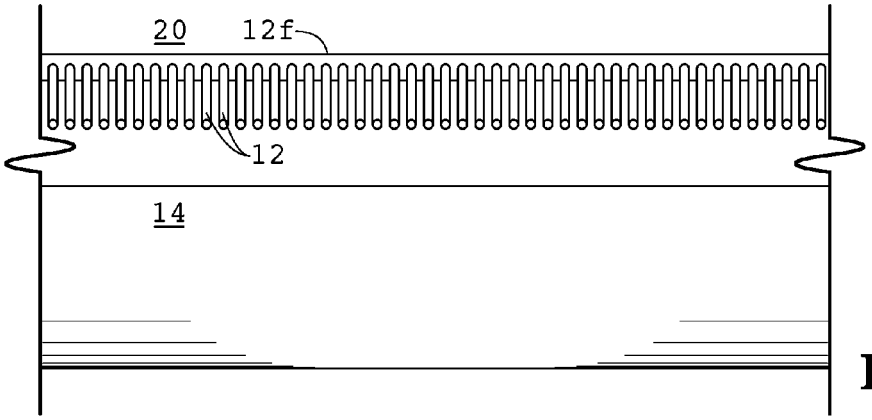
FIG. 11 is a front schematic view illustrating the embodiment of FIG. 1.

In an embodiment shown in FIGS. 1 and 11, the GLSB 10 uses substantially parallel, spaced rod members 12 to form the bridge that supports the debris as it is carried across the upwardly facing opening of the gutter 14 to the far edge 14*f* of the gutter 14. The rod members 12 can be made of any metal, such as steel or aluminum, or plastic, polymer-reinforced composites or any other suitable material. The rod members 12 preferably range in diameter from about 0.03 to about 0.06 inches. The rods should be of minimum diameter possible and the sizes listed can be combined with larger rods or smaller rods. Of course, other diameters are contemplated if they are sufficiently strong and otherwise suitable. The rods are a length that allows them to span the distance across the gutter 14 that is required to carry and support debris over the gutter 14. As an example, for a conventional piece of five inch wide aluminum gutter, the rod member 12 is a length that permits it to overhang the far edge 14*f* by about one-half to one and one-half inches. Therefore, useful rods could be six to seven inches long, depending on how and where the rods are attached to the building or gutter.

The rods are preferably spaced laterally from each next adjacent rod to form a gap therebetween of about one-quarter of an inch or less, but this distance can be modified as will become apparent to the person of ordinary skill. Each rod member 12 is preferably aligned substantially perpendicular to the gutter's longitudinal axis, although a small angle is possible as will become apparent from the description herein. When aligned substantially perpendicular to the gutter's longitudinal axis, the rod members 12 are aligned with their longitudinal axis substantially along the direction debris and water flow down the roof 20 when under the influence of gravity. That is, the rod members 12 are substantially parallel, or only slightly transverse, to the direction water and debris flow down the roof 20 under the influence of gravity (wind and other effects may vary the direction). The rods are also substantially parallel to one another. This configuration allows the rod members 12 to provide as little resistance to continued flow of debris over the gutter, while allowing water to flow between the rod members 12 into the gutter with little resistance. In order to maintain the rods parallel to one another, the rods themselves preferably have a spring effect that is substantial enough that if a rod is bent to one side, upon release it returns substantially to its original position. This "spring effect" can arise by using spring steel, for example.

Each rod member 12 can be mounted at the gutter 14 near the inner edge of the gutter 14*i*. The rod members 12 extend from or near the roof's edge 20*e* in cantilevered fashion above and beyond the far edge 14*f* of the gutter 14, as shown in FIGS. 1 and 11. A vertical gap, g, is formed between the top surface of the far edge 14*f* of the gutter and the lower surfaces of each of the rod members 12. The vertical gap, g, is to allow leaves and leaf-like debris that have portions (stems, thorns, etc.) that may extend downwardly through the gaps between the rods to flow to the ends of the rods without resistance, such as from catching on the gutter's far edge, as the debris slides down the parallel rod members 12. The vertical gap between the far ends of the rods and the top of the gutter allows leaves and other debris that are low-hanging between and beneath the rods to slide past the end of the gutter as they move downhill along the rods, and not catch thereon.

The rod members 12 are substantially parallel and form a "comb-like" structure over the gutter 14 with the "teeth" of the "comb" being formed by the rod members 12. A spine or frame 12*f*, to which the rods mount, is substantially perpendicular to the rods and attaches uphill of the gutter 14. The rod members 12 are cantilevered to as far beyond the far edge 14*f* of the gutter 14 as is necessary to assure most or all debris completely bypasses the gutter 14 and falls away from the gutter. The back or "spine" of the "comb" preferably attaches to the house structure 30, roof edge 20*e*, or inner edge 14*i* of the gutter 14, but the frame 12*f* can simply rest upon the surface of the roof 20. The rods 12 are preferably angled substantially parallel, or slightly transverse, to the roof 20, so that a generally downhill slope results. The frame can be integrated into the lower edge 20*e* of the roof 20, such as by inserting rods into spaced apertures disposed along a half-round piece of plastic, wood or metal that is attached at the lower edge of the roof, within the thickness of the lower edge 20*e*.

In one embodiment contemplated, the frame of the "comb" is integral to the gutter's inner edge 14*i*, having been mounted there during manufacture of the gutter. In another embodiment contemplated, rubber or other flexible roofing sheet material that is self-adhesive is adhered to the roof and over the frame of the comb-shaped structure to direct water falling down the roof over the frame of the comb. The rods can extend through apertures formed in the rubber sheet so that the sheet extends beneath the rods a short distance after passing over the frame and toward the roof edge 20*e*. The rods cantilever above the gutter's far edge.

The rods' lengths can be a few inches to about a foot or even more depending on whether the rear attachment point of the rods is at the back of the gutter or on the roof. Thus, the rods preferably extend from just above and just beyond the far edge 14*f* of the gutter to as far back toward or on the roof 20 as is necessary to reach the desired mounting or resting point of the frame. The rods 12 are sloped downward from the rear attachment point at the frame to the far edge 14*f* of the gutter 14 to form a self-clearing leaf slide that guides leaves and leaf-like debris along a continuously sloped structure away from the sloped roof, onto the sloped rods and then off of the rods to the ground or a container for collection.

Figure 2:
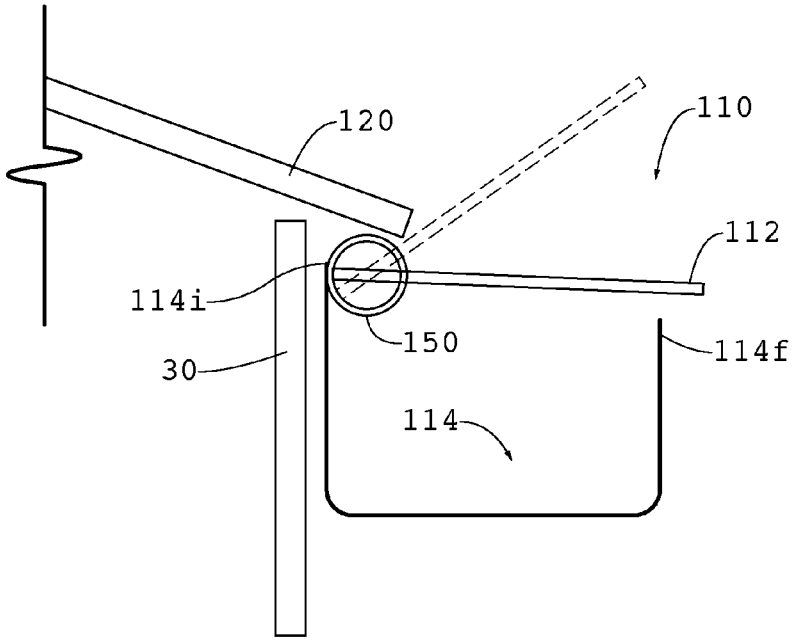
FIG. 2 is a side schematic view illustrating an alternative embodiment of the present invention.

One type of GLSB uses short lengths of rods attached to a frame formed from a pipe 150 or round drill stock, as shown in FIG. 2. The pipe 150 is attached above the rear edge 114*i* of the gutter 114 with u-bolts (not visible) or a novel snap-in fastening device that allows the pipe 150 to pivot within the u-bolts or other fastener in the manner of a hinge. This pivoting is along an angle of about 30 to 90 degrees to an "up position" (see dashed lines in FIG. 2) from the rods' 112 operable location above the front gutter edge 114*f*. The pivoting allows access to the inside of the gutter 114 for periodic cleaning or other maintenance. As noted above, the pipe 150 can be mounted to a structure that is deliberately formed in the gutter during manufacture of the gutter (see FIG. 6), or the pipe 150 can be retro-fitted, or the pipe can be mounted to the house's roof 120 or fascia.

One advantage of the pipe 150 structure shown in FIG. 2 is that the water tends to be driven downwardly, perpendicular to the rods 112. As the water flows off the roof 120 it immediately flows along the curved surface of the pipe 150, which is substantially perpendicular to the rods 112 at the intersection of the rods 112 with the pipe 150. By directing the flow of water perpendicular to the rods at the intersection, this configuration reduces the probability that the water will cling by surface tension to the rods 112 and flow off the ends of the rods rather than fall into the gutter 114. Thus, when the pipe 150 forms an approximately ninety-degree angle with the rods 112 at their intersection, there is a substantial structural and functional advantage.

Figure 3:
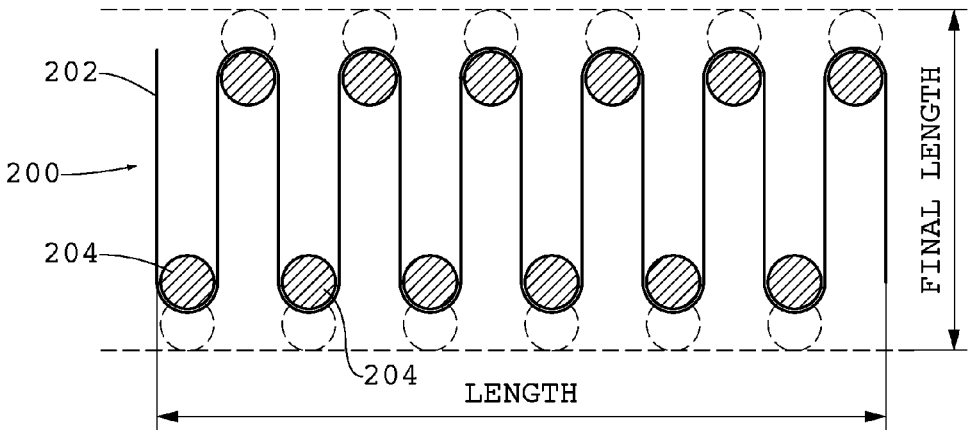
FIG. 3 is a top schematic view illustrating a mechanism for forming a portion of the present invention.

Another GLSB is made from a wire mat 200, as shown in FIG. 3. The mat 200 can be about one foot wide, and is made by bending one strand of wire 202 back and forth around a die that consists of a plurality of dowels 204 or other prepared, solid structures at each side to form parallel wires that serve as the rods spaced about one quarter inch apart (see FIG. 3). Once the wire 202 is wound through and around the dowels 204, the dowels are moved apart by force to remove any slack in the wire 202 and form the final length of the rods. The curved portions at the ends of each pair of rods can be cut off, or they can be retained and bent downwardly and inwardly to allow the debris to clear the curved ends as it falls off the rods, and also direct water into the gutter using surface tension on the rods. In this case the downwardly bent portions may not touch the gutter, but form a barrier to prevent larger rodents and other creatures from entering the gutter. The curved portions can be bent downwardly and inwardly to form a support leg that rests upon the far edge of the gutter as described herein, which also provides a barrier for pests.

Figure 4:
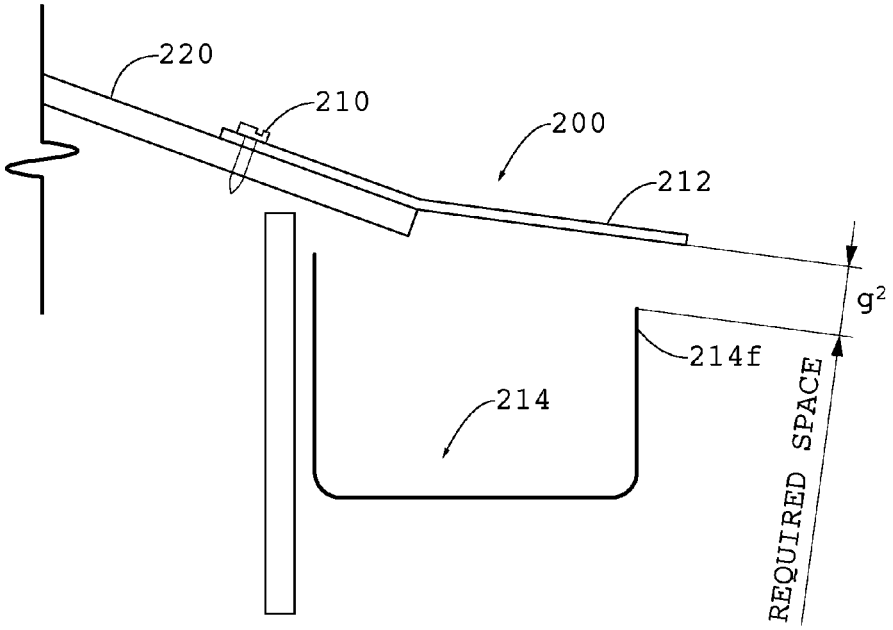
FIG. 4 is a side schematic view illustrating an alternative embodiment of the present invention.
Figure 5:
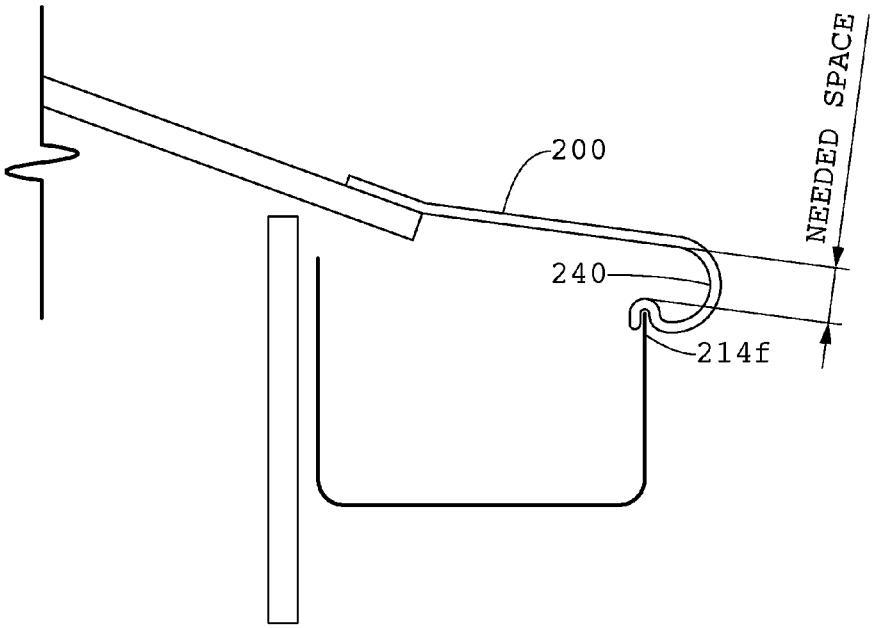
FIG. 5 is a side schematic view illustrating an alternative embodiment of the present invention.

As shown in FIG. 4, one side of the mat 200 so formed is attached to the roof 220 (such as by a screw 210 extending through the roof side curved portions) and the other side of the mat 200 cantilevers above the far edge 214*f* of the gutter 214. The vertical gap, g2, formed between the front gutter edge 214*f* and the underside of the mat 200 can be maintained by forming support structures at periodic intervals along the mat's length using parts of the mat formed. For example, during manufacture of the wire mat 200, some of the wire 202 can be bent toward the gutter to form spaced "legs" 240 under the mat 200 that rest on the far edge 214*f* of the gutter (see FIG. 5). These legs are spaced supports that contact the gutter 214 and space the gutter 214 from the mat 200. A continuous GLSB can be made using this configuration because the top surfaces of the rods extend past the far edge of the gutter.

The mat 200 can be bent in its long direction along the roof to fit into a valley formed between two intersecting and transverse roof sections. A rubber roofing material can be adhered over the uppermost portion of the mat and the roof in order to force water and debris onto the top of the mat. Such a configuration permits the mat to carry debris out of the valley where it would otherwise collect, but water is permitted to flow through the rods to the gutter. Preferably, the lower ends of the rods extend over the far edge of the intersecting gutters' corner (or any vertical shield that is mounted to the gutter lip at this corner to direct the large volume of water from the valley into the gutter) in order to bridge entirely over the gutter.

By using wire stock from a large spool of wire at the job site, a mat can be formed on-site of desired width, wire spacing and length using special wire-forming equipment made for this purpose. As the wire (about one-sixteenth inch diameter) comes off the reel it is work-hardened and made straight. Next it is placed in a flat die having dowels at each end of the mat's width to wrap around and form the wire spacing of the rods. The dowels at each end are pulled apart for forming the final length of the mat (see FIG. 3). The flat mat formed is cut into lengths, for example three feet long. Then the mat can be bent to curve the mat for each field need of gutter width and height to roof relationship. A gap can be formed between the far edge of the gutter and the wire mat bridge. Also a cantilever (ideal) mat can be formed by attaching a bent mat to the roof and cutting off the opposite end to form separate rods 212 as shown in the illustration of FIG. 4.

In one embodiment, the invention is formed in units of a specific length, such as three feet, and each unit is attached to other units in series. The attached collection of units is mounted along the gutter's length. The length of each unit of the apparatus (as measured along the gutter's length) can be on the order of a few feet for ease of installation of each unit. Alternatively, the apparatus can be constructed to be continuous along the length of the gutter in some embodiments so that there are no connectors or weaknesses that might be present in a series of connected units that depend on the installer's skill in connecting them.

The invention can take the form of a "comb" with the "teeth" being the rods, rails or bridging components and the transverse spine being a frame to which the rods mount. Alternatively, the invention can be in the form of disks with spacers like a large diameter washer spaced with a smaller diameter washer. Alternatively, a broom-like device can be used with the broom straws acting as the bridge over the gutter, and the straws cantilevering above the ends of gutter the same as the comb teeth forming a gap.

As the parallel rods are made closer and closer together, this decreasing gap improves the action of sieving debris. However, the closer the rods are together the more likely capillary action will occur, which could cause some of the water to cling to, and flow along, the rods past the far edge of the gutter, thereby defeating the purpose of the gutter. The surface tension of the water and its velocity direction as it comes off the roof or rod-holding device can be in the direction of the rods. This problem can be reduced or eliminated by using finer and flatter rods. Another solution is to form sawtooth-shaped (when viewed from the side) and/or v-shaped (when viewed from the end) profiles on the bottoms of the rods that cause the water to have a smaller surface to cling to so it drops off into the gutter before reaching the ends of the rods.

An alternative solution can be obtained by placing the rods at an angle to the water direction coming off the roof, and another uses the surface tension of the water clinging to a sheet that the rods pass though to drop the water below the rods. For example, if a rubber sheet is adhered at its top edge to the roof and extends a short distance down the roof to cover the frame of the rods, the rods of the invention can pierce the sheet, which causes the rods to extend transversely (at an angle to the sheet) beyond the sheet's point of attachment to the roof. The sheet thus extends from above the rods to below the rods with the rods extending through the sheet. This configuration creates a flow path for water to flow onto the sheet from the roof, down the sheet and through the rods by clinging to the sheet due to surface tension. In this configuration, the water follows the sheet down through the rods, rather than following the rods at an angle to the sheet.

Figure 12:
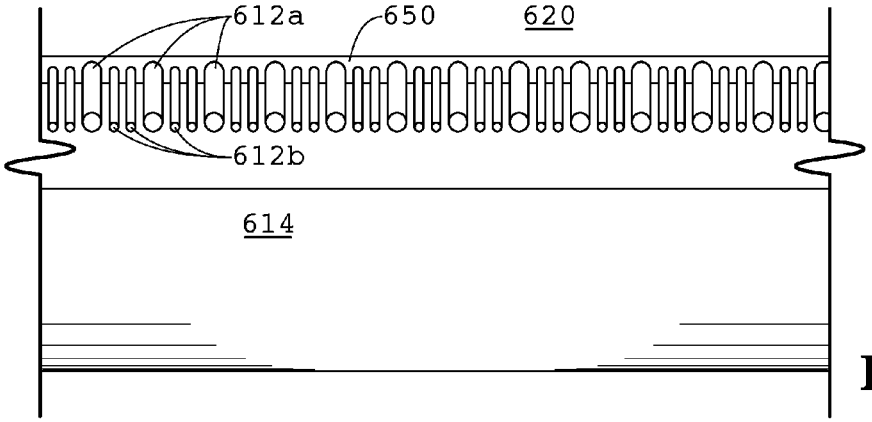
FIG. 12 is a front schematic view illustrating an alternative embodiment of the present invention.
Figure 13:
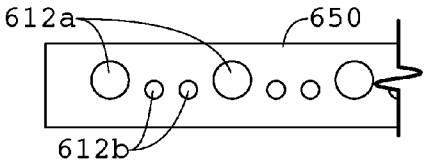
FIG. 13 is a magnified schematic view illustrating the embodiment of FIG. 12.
Figure 14:
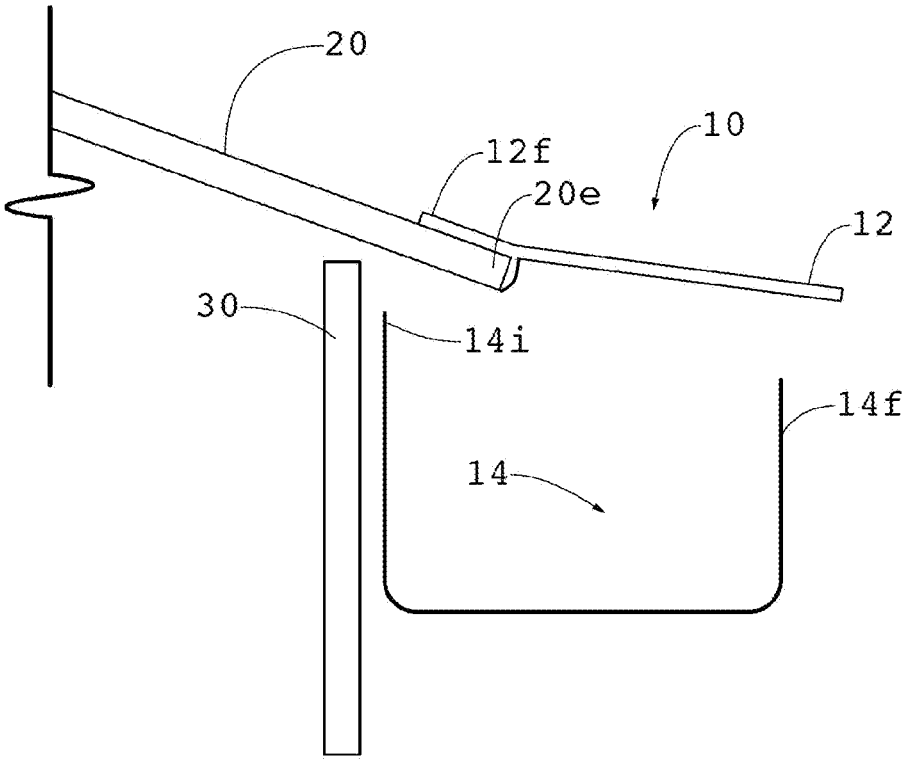
FIG. 14 is a schematic side view illustrating an embodiment having rods inserted into a frame attached to the roof at the lower edge of the roof.

Shorter rods could be passed under and between the main rods 12, 112 and 212 that carry off the leaves, and the shorter rods (which do not have to be as long as the main rods) cause the water on the bottoms of the main rods to be more likely to fall into the gutter, rather than be carried over the ends of the main rods and past the gutter. Such shorter rods could also help support the upper rods that cantilever over the far, outer edge of the gutter. Additionally, smaller diameter (e.g., one-thirty second of an inch) or shorter (or both) rods can be alternated with the preferred main rods (e.g., one sixteenth of an inch diameter) described herein to help carry smaller debris and thereby reduce the amount of matter that can hang down between the rods as the matter passes over the far lip of the gutter. This is illustrated in FIGS. 12 and 13, in which the main rods 612*a* are twice the diameter and long enough to reach past the far edge of the gutter, and the smaller diameter rods 612*b* are substantially the same length, but half the diameter. The smaller diameter rods 612*b* can be shorter, and preferably do not carry substantial weight of larger debris that falls onto the main rods 612*a*. Instead, the row of smaller diameter rods 612*b* filter the smaller debris that falls past the larger main rods 612*a*, and, because they are smaller diameter, the rods 612*b* promote water falling into the gutter 614, rather than flowing past the gutter's far edge. Furthermore, the smaller diameter rods 612*b* may be shorter than the gutter's width, so that even if water flows to their ends and then drops, the water falls into the gutter 614. If a second row of smaller diameter rods is placed beneath the row of larger diameter rods, the gaps between the smaller rods can be smaller than the gaps between the larger rods.

If metal sheeting is used to hold the rods, the sheeting could be formed to have rods and bring the water into the gutter. This could also be done as a plastic or metal molding and look much like a hair comb with its teeth hanging out over the end of the gutter and the spine of the comb (above the teeth) attached to the roof above the gutter.

In order to test the embodiments discussed above, a work table was made to hold a roof section having a gutter section at the low end and a water flow device at the high end. The roof section can be held at different slopes and different type roofing was placed on the table and different flow rates were selected. Leaves and roof debris was placed between the water source and the gutter on the roof section and the results were observed under closely controlled conditions.

The testing work supports the efficacy of the embodiments described herein. Most of the testing used one-sixteenth inch diameter rods and flat rods turned on edge (thinnest edges up and larger surfaces facing the next-adjacent rod). The testing showed that holding the rods parallel to one another is very important. The rods need to spring back to their original positions if they are deformed downwardly against the far edge of the gutter or laterally to a non-parallel relation. Furthermore, the capillary attraction of water to and between the rods increased as the rods were moved closer together and increased as the diameter of the rods increased.

The GLSB method and structures described herein show promise, because during testing the GLSB embodiments cleared a range of debris made up of small and large leaves, seed pods, twigs, and pine needles with a minimum of small debris going into the gutter. The amount that went into the gutter was cleared by normal flow of water in the gutter to the down spout. GLSB rods can be incorporated into a gutter so that the rods are manufactured along with the gutter and the two are integral. Different climate locations and debris types could call for different solutions to reduce cost and maintenance.

Applicant's studies show the cantilevered ends of the GLSB rods allow the debris to clear the end of the gutter. However, when the lower edges of the distal ends of the rods are held against the upper, outer edge of the gutter, leaves and debris are held back and do not slide off the ends of the rods. The studies thus far show that the slide made of thin rods perpendicular to the gutter's length and held above the outside edge of the gutter work better than the surface tension leaf rejection method that is conventional.

The water was brought below the rods of some embodiments by having the rods pass through metal or plastic sheeting as described above. The rods of other embodiments have been attached through plastic piping (having a one inch diameter and a one-eighth inch wall) and in others into one-quarter inch diameter solid rod stock. The sheeting can be part of the drip edge on the roof's edge, the sheeting can be part of the one inch diameter pipe between the drip edge and the gutter, and the sheeting can be part of the one-quarter inch rod on the roof itself.

Both the one inch diameter piping and the one-quarter inch solid rod can be mounted using a fastener that forms a hinge means for pivoting the GLSB rods to access the gutter for cleaning. This can be by rotating the pipe or rod to lift the GLSB rods. Stops can be put on the pipe or holding rod to define the maximum down and/or up position.

Rods can be formed by cutting a sheet along spaced, parallel lines and twisting the formed flat segments 90 degrees. Although this is an inexpensive method for forming GLSB rods, there can be problems with water attraction (capillary action) and holding the rods parallel.

Figure 6:
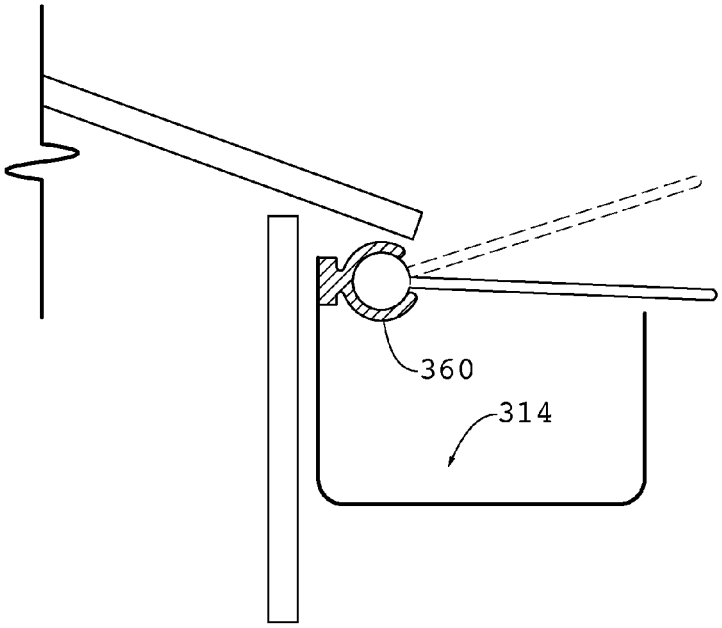
FIG. 6 is a side schematic view illustrating an alternative embodiment of the present invention.
Figure 7:
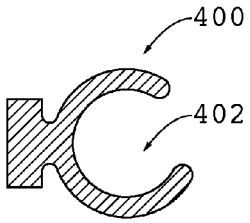
FIG. 7 is a side view in section illustrating a fastener portion for the present invention.
Figure 8:
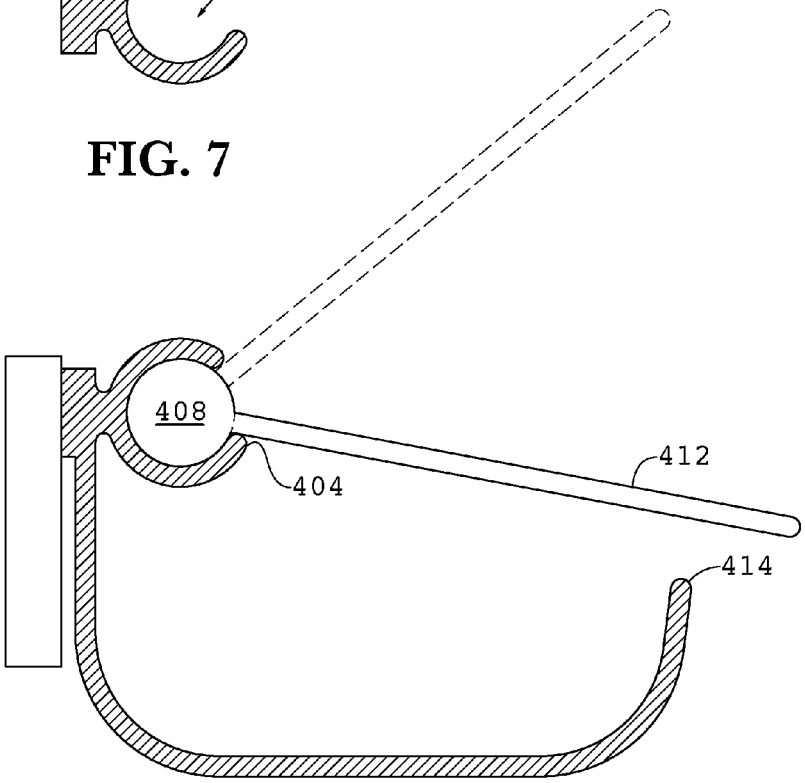
FIG. 8 is a side schematic view illustrating an alternative embodiment of the present invention.

The method of attaching the rods (teeth) to the back of the gutter, when the "comb" design is being used, will now be described in detail. For a new gutter system using GLSB or for a flat, high-back gutter already in use, a holding device 360 can be attached to the upper part of the back edge of the gutter 314 that allows the GLSB to be snapped in place, moved up or taken off easily, as shown in FIG. 6. The holding device 360 can be molded out of plastic or metal that is attached to a conventional gutter 314, or the holding device 360 can be extruded as part of a plastic gutter. In the illustrations of FIGS. 7 and 8, the pivot structure 400 defines a C-shaped opening 402 for the cylindrical frame 408 of the comb-shaped device 412 to snap into. The lower tip 404 of the "C" provides a limit for downward movement of the rods of the device 412, because the rods will rest against the lower tip 404 and maintain the vertical spacing between the rods and the far edge of the gutter. In order for the rods to move any lower, they must be bent. However, the rods can be lifted upwardly for cleaning as shown in FIG. 8 in dashed lines.

Figure 9:
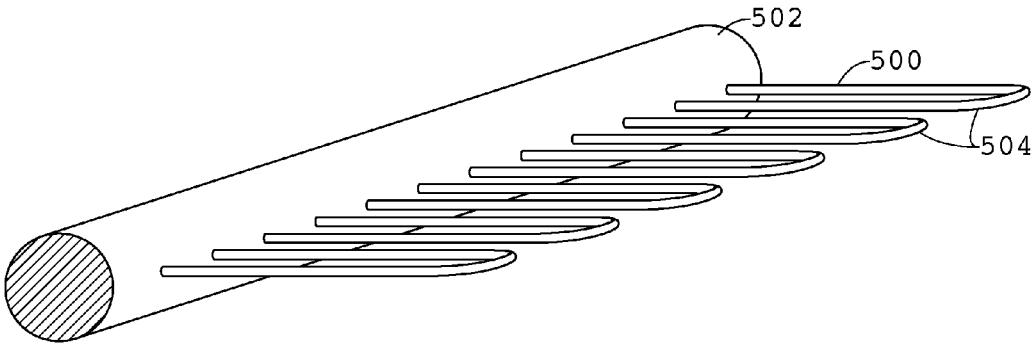
FIG. 9 is a schematic view in perspective illustrating an alternative embodiment of a portion of the present invention.
Figure 10:
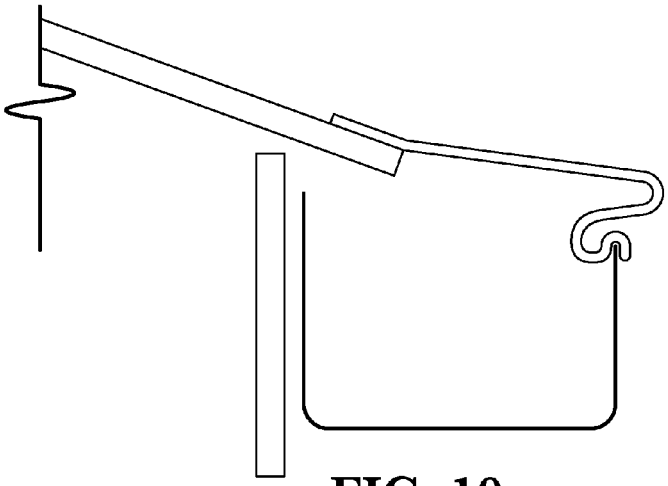
FIG. 10 is a side schematic view illustrating an alternative embodiment of the present invention.

As shown in FIG. 8, the frame 408 of the comb-shaped structure 412 is mounted in the holding device 400 in such a way (such as a friction fit) that pivoting up or down is possible when a sufficient force is applied. However, it is preferred that downward pivoting does not occur without deliberately moving the rods, in order to maintain the space between the lip of the gutter 414 and the bottom of the rods. As shown in FIG. 9, the comb can be molded or made from wire 500 attached to a dowel 502, and that dowel 502 can serve as a frame and be inserted in the holding device 400 as shown above, with the wire 500 serving as the rods.

As shown in FIG. 9, the wire 500 has curved ends 504 that join adjacent pairs of wire. This means that any large debris sliding down the wires can catch in the curved ends 504 and not fall off the structure. It is preferred to either cut the curved ends off back to the straight portions of the wire 500, or bend the curved ends downward toward the gutter (not visible) and back to allow the debris to clear the curved ends. The curved ends can form legs that support the wire 500 at the far edge of the gutter when the wire contacts the far edge of the gutter.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An apparatus in combination with a gutter mounted to a building having a roof with at least one roof portion extending downwardly to a lower roof edge above an upwardly facing gutter opening that receives precipitation, the gutter having a first gutter edge closer to the building and a second gutter edge farther from the building wherein the first and second gutter edges are the highest portions of the gutter with the gutter opening defined between the first and second gutter edges, the apparatus comprising:

(a) a plurality of spaced, substantially parallel rods defining continuous voids between adjacent rods, each of said rods having a first rod end attached to the building adjacent the first gutter edge and an opposite, second rod end disposed adjacent the second gutter edge, at least some of the rods mounted at their first rod ends to at least one sheet that extends over at least upper and end surfaces of the lower roof edge, the plurality of rods extending across the gutter opening with a downward slope between the first rod ends and the second rod ends for causing debris resting on the rods to slide down the rods beyond the second gutter edge without falling into the gutter opening, wherein each rod has a gutter span that is defined as each rod's entire length that is above the gutter opening beyond the lower roof edge, and wherein the continuous voids extend uninterrupted through each rod's entire height along the entire gutter spans of the adjacent rods; and (b) said second rod ends of at least some of the rods extend past the second gutter edge without contacting the second gutter edge.

2. The apparatus in accordance with claim 1, wherein said at least one sheet further comprises a frame from which the first rod ends extend substantially perpendicularly.

3. An apparatus in combination with a gutter mounted to a building having a roof with at least one roof portion extending downwardly to a lower roof edge above an upwardly facing gutter opening that receives precipitation, the gutter having a first gutter edge closer to the building and a second gutter edge farther from the building wherein the first and second gutter edges are the highest portions of the gutter with the gutter opening defined between the first and second gutter edges, the apparatus comprising:

(a) a plurality of spaced, substantially parallel rods defining continuous voids between adjacent rods, each of said rods having a first rod end attached to the building above the first gutter edge and an opposite, second rod end disposed adjacent the second gutter edge, at least some of the rods mounted at their first rod ends to at least one sheet that extends over at least upper and end surfaces of the lower roof edge, the plurality of rods extending across the gutter opening with a downward slope between the first rod ends and the second rod ends for causing debris resting on the rods to slide down the rods beyond the second gutter edge without falling into the gutter opening, wherein each rod has a gutter span that is defined as each rod's entire length that is above the gutter opening beyond the lower roof edge, and wherein the continuous voids extend uninterrupted through each rod's entire height along the entire gutter spans of the adjacent rods and to the second rod ends, wherein the second rod ends are free ends; and (b) tip portions of at least some of the rods extend downwardly to the second gutter edge and contact the gutter for supporting the rods.

4. The apparatus in accordance with claim 3, wherein said at least one sheet further comprises a frame from which the first rod ends extend substantially perpendicularly.

5. An apparatus in combination with a gutter mounted to a building having a roof with at least one roof portion extending downwardly to a lower roof edge above an upwardly facing gutter opening that receives precipitation, the gutter having a first gutter edge closer to the building and a second gutter edge farther from the building wherein the first and second gutter edges are the highest portions of the gutter with the gutter opening defined between the first and second gutter edges, the apparatus comprising:

(a) a plurality of spaced, substantially parallel rods defining continuous voids between adjacent rods, each of said rods having a first rod end contacting the building and an opposite, second rod end disposed adjacent the second gutter edge, at least some of the rods mounted at their first rod ends to at least one sheet that extends over at least upper and end surfaces of the lower roof edge, the plurality of rods extending across the gutter opening with a downward slope between the first rod ends and the second rod ends for causing debris resting on the rods to slide down the rods beyond the second gutter edge without falling into the gutter opening, wherein each rod has a gutter span that is defined as each rod's entire length that is above the gutter opening beyond the lower roof edge, and wherein the continuous voids extend uninterrupted through each rod's entire height along the entire gutter spans of the adjacent rods; and (b) at least some of the plurality of rods have edge portions that extend above and beyond the second gutter edge without contacting the second gutter edge to permit debris to slide past the gutter opening, and a remainder of the plurality of rods have edge portions that extend downwardly to the second gutter edge for supporting said rods by resting upon the second gutter edge.

6. The apparatus in accordance with claim 5, wherein said at least one sheet further comprises a frame from which the first rod ends extend substantially perpendicularly.

7. An apparatus in combination with a gutter mounted to a building having a roof with at least one roof portion extending downwardly to a lower roof edge above an upwardly facing gutter opening that receives precipitation, the gutter having a first gutter edge closer to the building and a second gutter edge farther from the building wherein the first and second gutter edges are the highest portions of the gutter with the gutter opening defined between the first and second gutter edges, the apparatus comprising:

(a) a plurality of spaced, substantially parallel rods defining continuous voids between adjacent rods, each of said rods having a first rod end disposed adjacent the building and an opposite, second rod end disposed adjacent the second gutter edge, at least some of the rods mounted at their first rod ends to a frame that attaches at the lower roof edge, the plurality of rods extending across the gutter opening with a downward slope between the first rod ends and the second rod ends for causing debris resting on the rods to slide down the rods beyond the second gutter edge without falling into the gutter opening, wherein each rod has a gutter span that is defined as each rod's entire length that is above the gutter opening beyond the lower roof edge, and wherein the continuous voids extend uninterrupted through each rod's entire height along the entire gutter spans of the adjacent rods; and (b) said second rod ends of at least some of the rods extend past the second gutter edge without contacting the second gutter edge.

8. An apparatus in combination with a gutter mounted to a building having a roof with at least one roof portion extending downwardly to a lower roof edge above an upwardly facing gutter opening that receives precipitation, the gutter having a first gutter edge closer to the building and a second gutter edge farther from the building wherein the first and second gutter edges are the highest portions of the gutter with the gutter opening defined between the first and second gutter edges, the apparatus comprising:

(a) a plurality of spaced, substantially parallel rods defining continuous voids between adjacent rods, each of said rods having a first rod end disposed adjacent the building and an opposite, second rod end disposed adjacent the second gutter edge, at least some of the rods mounted at their first rod ends to a frame that attaches at the lower roof edge, the plurality of rods extending across the gutter opening with a downward slope between the first rod ends and the second rod ends for causing debris resting on the rods to slide down the rods beyond the second gutter edge without falling into the gutter opening, wherein each rod has a gutter span that is defined as each rod's entire length that is above the gutter opening beyond the lower roof edge, and wherein the continuous voids extend uninterrupted through each rod's entire height along the entire gutter spans of the adjacent rods and to the second rod ends, wherein the second rod ends are free ends; and (b) tip portions of at least some of the rods extend downwardly to the second gutter edge and contact the gutter for supporting the rods.

9. An apparatus in combination with a gutter mounted to a building having a roof with at least one roof portion extending downwardly to a lower roof edge above an upwardly facing gutter opening that receives precipitation, the gutter having a first gutter edge closer to the building and a second gutter edge farther from the building wherein the first and second gutter edges are the highest portions of the gutter with the gutter opening defined between the first and second gutter edges, the apparatus comprising:

(a) a plurality of spaced, substantially parallel rods defining continuous voids between adjacent rods, each of said rods having a first rod end disposed adjacent the building and an opposite, second rod end disposed adjacent the second gutter edge, at least some of the rods mounted at their first rod ends to a frame that attaches at the lower roof edge, the plurality of rods extending across the gutter opening with a downward slope between the first rod ends and the second rod ends for causing debris resting on the rods to slide down the rods beyond the second gutter edge without falling into the gutter opening, wherein each rod has a gutter span that is defined as each rod's entire length that is above the gutter opening beyond the lower roof edge, and wherein the continuous voids extend uninterrupted through each rod's entire height along the entire gutter spans of the adjacent rods; and (b) at least some of the plurality of rods have edge portions that extend above and beyond the second gutter edge without contacting the second gutter edge to permit debris to slide past the gutter opening, and a remainder of the plurality of rods have edge portions that extend downwardly to the second gutter edge for supporting said rods by resting upon the second gutter edge.

* * * * *